US007455201B2

(12) United States Patent
Mitsui et al.

(10) Patent No.: US 7,455,201 B2
(45) Date of Patent: Nov. 25, 2008

(54) SLIDE GATE VALVE UNIT FOR CASTING MACHINE

(75) Inventors: Kenji Mitsui, Akaiwa (JP); Mototsugu Osada, Bizen (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 15 days.

(21) Appl. No.: 11/667,489

(22) PCT Filed: Nov. 7, 2005

(86) PCT No.: PCT/JP2005/020370

§ 371 (c)(1),
(2), (4) Date: May 10, 2007

(87) PCT Pub. No.: WO2006/051753

PCT Pub. Date: May 18, 2006

(65) Prior Publication Data

US 2007/0267591 A1 Nov. 22, 2007

(30) Foreign Application Priority Data

Nov. 11, 2004 (JP) ..... 2004-327405

(51) Int. Cl.
*B22D 41/26* (2006.01)

(52) U.S. Cl. ..... 222/600; 251/174; 251/195

(58) Field of Classification Search ..... 251/327, 251/329, 120, 121, 174, 195, 203; 222/600, 222/599

See application file for complete search history.

(56) References Cited

U.S. PATENT DOCUMENTS

| | | | | | |
|---|---|---|---|---|---|
| 4,991,753 | A * | 2/1991 | Inubushi et al. | ..... | 222/598 |
| 5,651,909 | A * | 7/1997 | Taira et al. | ..... | 222/600 |
| 5,698,129 | A * | 12/1997 | Keller et al. | ..... | 222/600 |
| 6,276,573 | B1 * | 8/2001 | Tofuku et al. | ..... | 222/600 |

FOREIGN PATENT DOCUMENTS

| | | | |
|---|---|---|---|
| JP | 59-228971 | A | 12/1984 |
| JP | 1-38592 | B2 | 8/1989 |
| JP | 4-157061 | A | 5/1992 |
| JP | 10-128525 | A | 5/1998 |
| JP | 2000-190067 | A | 7/2000 |
| WO | WO 2005042191 | A1 * | 5/2005 |

* cited by examiner

*Primary Examiner*—John Bastianelli
(74) *Attorney, Agent, or Firm*—Birch, Stewart, Kolasch & Birch, LLP

(57) ABSTRACT

A pressing means for pressing a slide plate against a fixed plate by uniform pressure has simple, strong construction and can be easily assembled. A slide gate valve unit includes a pair of pressing members 10 having a U-shaped cross section and capable of receiving protrusions 11 protruding from sides of a base frame secured to the lower surface of the bottom wall of a molten metal container and the lower surfaces of side parts of a slide case 4. Elastic members 12 are extended between upper parts 10*a* of the pressing members and the upper surfaces of the protrusions of the base frame. Side parts of the slide case 4 are supported on the upper surfaces of the lower parts 10*b* of the pressing members.

6 Claims, 5 Drawing Sheets

SLIDE GATE VALVE UNIT FOR CASTING MACHINE

This Nonprovisional application is the national phase of PCT International Application No. PCT/JP2006/020370 filed on Nov. 7, 2005 under 35 U.S.C. § 371, and claims priority under 35U.S.C. § 119(a) on Patent Application No(s). JP 2004-327405 filed in Japan on Nov. 11, 2004. The entire contents of each of the above-identified applications are hereby incorporated by reference.

TECHNICAL FIELD

The present invention relates to a slide gate valve unit for a casting machine and, more particularly, to a slide gate valve unit provided with a pressing means for pressing a slide plate against a fixed plate by a predetermined pressure.

BACKGROUND ART

A sliding gate valve for opening and closing a discharge opening formed in the bottom wall of a molten metal container is secured to the bottom of the molten metal container A two-layer type slide gate valve unit embodying the present invention will be described with reference to FIG. 3. A base frame 2 is secured to the bottom wall of a molten metal container 1. A fixed plate 3 is combined with the base frame 2. A slide plate 5 and a shoot nozzle 6 are supported on a slide case 4 disposed under the fixed plate 3. The slide case 4 is pushed and pulled by a hydraulic or electric cylinder actuator 7 to align the nozzle hole 5*a* of the slide plate 5 with the nozzle hole 3*a* of the fixed plate 3 and to disconnect the nozzle hole 5*a* of the slide plate 5 from the nozzle hole 3*a* of the fixed plate 3. Thus the discharge of the molten metal from the molten metal container through an insert nozzle 8 is controlled. In some cases, a long nozzle or an immersion nozzle is put on the shoot nozzle 6.

The slide case 4 is pushed upward by a pressing means including a spring to press the slide plate 5 against the fixed plate 3 by a predetermined pressure to prevent the leakage of the molten metal from the respective nozzle holes 3*a* and 5*a* of the plates 3 and 5 and the penetration of air into the molten metal.

The pressing means of the slide gate valve unit of such basic construction is a spring means disclosed in, for example, Patent document 1.

In the known spring means, a lower pin extending upward so as to penetrate a casing frame supporting a slide frame and an upper pin extending downward so as to penetrate a fixed frame are connected by screwing, a compression spring is extended between the head of the upper pin and the fixed frame so as to exert the resilience of the compression spring on the head of the upper pin to pull up the lower pin. Consequently, the casing frame supporting the slide case is pulled up by the lower pin to press the slide plate against the fixed plate by a predetermined pressure.

This known pressing means uses the two pins. The two pins need to be connected by screwing after being extended through the casing frame and the fixed plate, respectively. Thus this known pressing means needs troublesome assembling work and many parts, the pins having strength sufficient to pull up the slide case need to be thick ones, the compression spring necessarily has a big outside diameter, and hence the pressing means needs a large space for installation.

The casing frame is fastened to the base frame with bolts. Therefore the casing frame is irregularly joined to the base frame and it is difficult to press the sliding surface of the slide plate uniformly against the sliding surface of the fixed plate, which is undesirable from the viewpoint of preventing the leakage of the molten metal and the penetration of air into the molten metal.

Patent document 1: JP 1-38592 B

DISCLOSURE OF THE INVENTION

Problem to be Solved by the Invention

The present invention intends to press the slide plate against the fixed plate so that uniform pressure acts on the joining surfaces of the slide plate and the fixed plate, to simplify the construction of the pressing means by reducing the number of parts of the pressing means, to facilitate assembling the pressing means, to enhance the strength of a support means supporting the slide case and to enhance safety.

Means for Solving the Problem

The present invention provides a slide gate valve unit including: a fixed plate combined with a base frame secured to the lower surface of the bottom wall of a molten metal container; a slide case supported for sliding under the fixed plate, internally provided with a slide plate and suspending a shoot nozzle; and a drive means for controlling the discharge of a molten metal by moving the slide case so as to align a nozzle hole formed in the slide plate with a nozzle hole formed in the fixed plate and so as to disconnect the nozzle hole of the slide plate from the nozzle hole of the fixed plate; wherein right and left pressing members having a U-shaped cross section receive protrusions protruding from sides of the base frame and the lower surfaces of side parts of the slide case, elastic members are extended between upper parts of the pressing members and the upper surfaces of the protrusions of the base frame and side parts of the slide case are supported on the upper surfaces of the lower parts of the pressing members, and the resilience of the elastic members pushes the pressing members upward so that the slide case is pushed upward by the lower parts of the pressing members to press the respective sliding surfaces of the fixed plate and the sliding plate together by a predetermined pressure.

The slide gate valve unit is provided with a means for facilitating the replacement of slide plate and the shoot nozzle. In the slide gate valve unit according to the present invention, at least two support members are attached to each of side parts of the slide case so as to be in contact with the upper surface of the lower parts of the pressing member to support the slide case slidably, bearing arms slidably put on a shaft fixed to the base frame is attached to one side part of the slide case with respect to the moving direction of the slide case to enable the slide case to turn outward, a cut is formed in the lower part of each of the pressing members to enable one of the support members to pass the cut when the other support member comes off an end of the lower part of pressing member, and the slide case turns outward on the shaft when the support members come off the ends of the lower parts and the other support members can pass the cuts, respectively.

Preferably, parts of the upper surface of the lower part of each pressing member are inclined surfaces sloping down toward the end and the cut, respectively.

Although one support member on each side of the slide case is sufficient for satisfactory function, it is preferable to attaché the plurality of support members to each side because pressure can be more uniformly distributed on the sliding surfaces when the plurality of support members are attached to each side.

Preferably, the slide gate valve unit according to the present invention is provided with a stopper for determining the stroke of an actuating member included in the driving means, such as a hydraulic cylinder actuator or an electric cylinder actuator, for sliding the slide case, the stopper is advanced to its working position to hold the slide case at a position for discharging the molten metal and the stopper is retracted from the working position to permit the slide case to be moved to a position where the slide case can be turned outward.

In the slide gate valve unit according to the present invention, the positional relation between the pressing members and the rollers serving as support members for supporting the slide case may be reversed, the rollers may be attached to the lower parts of the pressing members, the support members supporting the slide case may be rails capable of moving on the rollers, the pressing members may be pushed against the resilience of the elastic members when the support members move on the rollers to press the sliding surface of the slide plate against the sliding surface of the fixed plate by a predetermined pressure.

EFFECT OF THE INVENTION

According to the present invention, the pressing members having a substantially U-shaped cross section are used both for holding the elastic members for pressing the slide plate supported on the slide case against the fixed plate by a predetermined pressure and for supporting the slide case. Therefore, the slide gate valve unit needs a small number of parts, can be easily assembled, the pressing member having a U-shaped cross section have high strength sufficient for supporting the slide case.

The lower sides of the pressing members supporting the slide case serve also as rails. Therefore, any support rails specially for supporting the slide case are not necessary, the slide gate valve unit is very simple in construction.

BEST MODE FOR CARRYING OUT THE INVENTION

Figure 1:
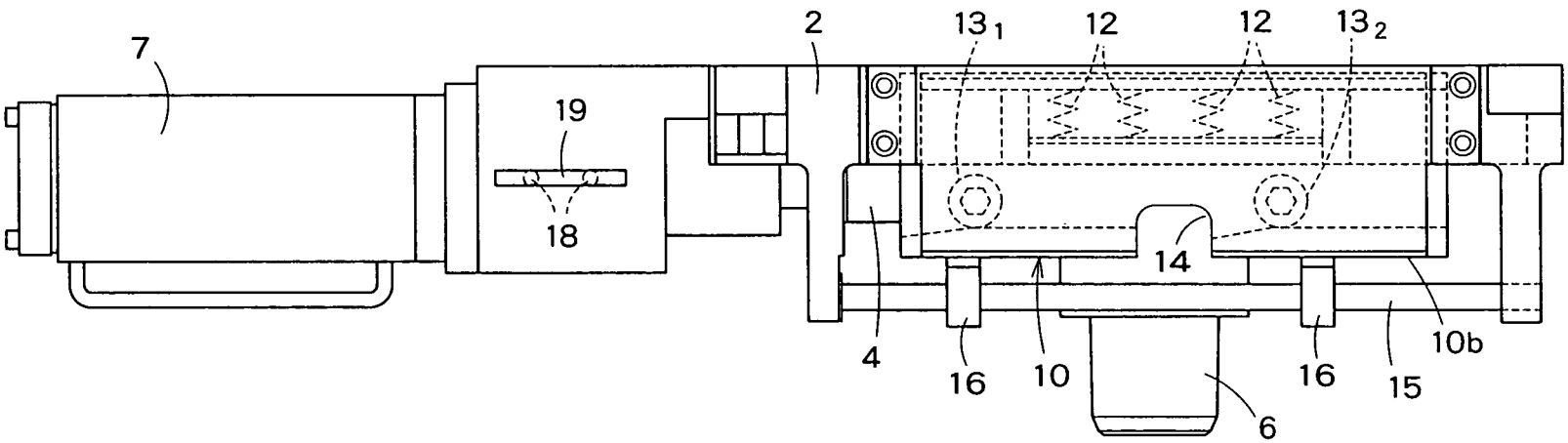
FIG. 1 is a side elevation of a slide gate valve unit in a preferred embodiment according to the present invention.
Figure 2:
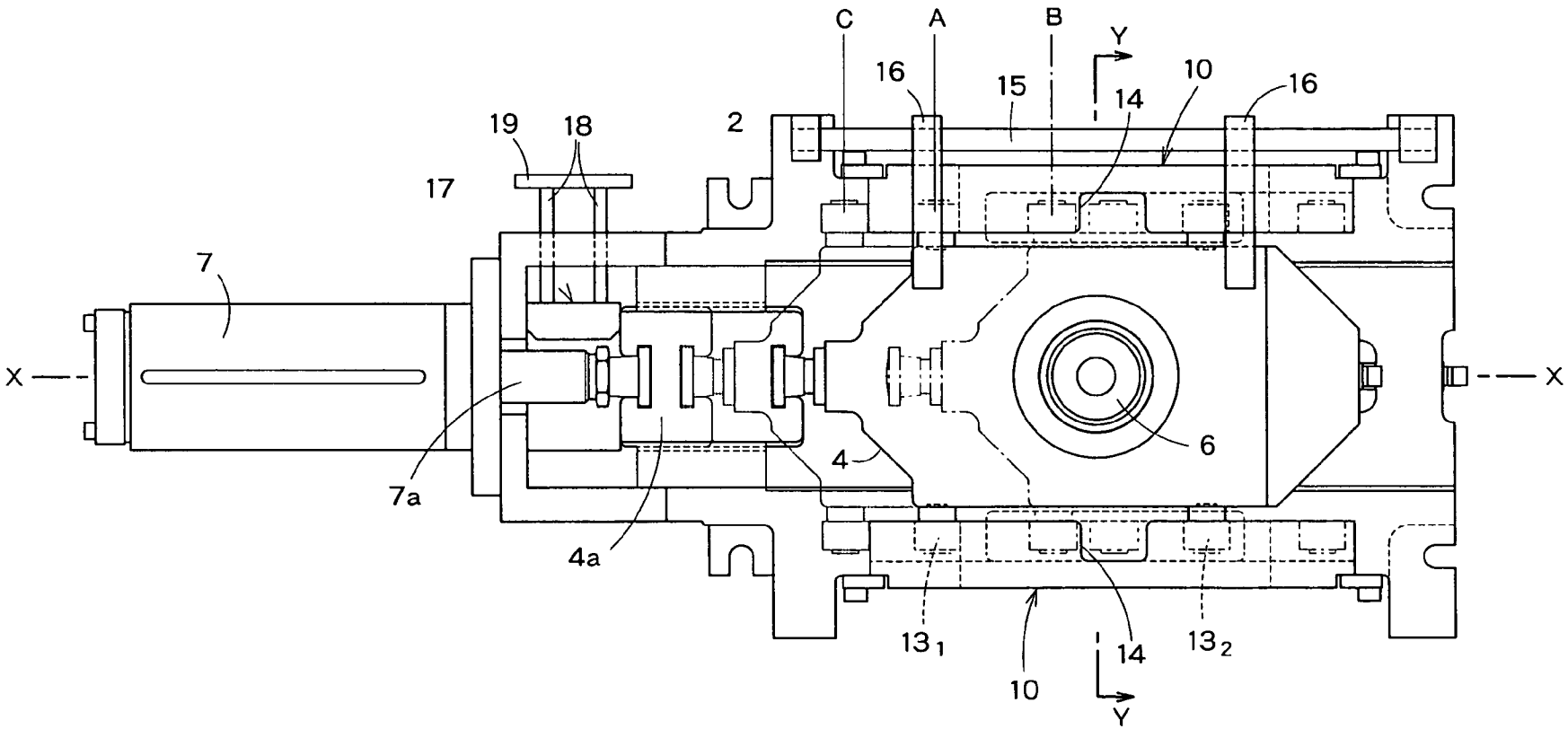
FIG. 2 is a bottom view of the slide gate valve unit shown in FIG. 1.
Figure 3:
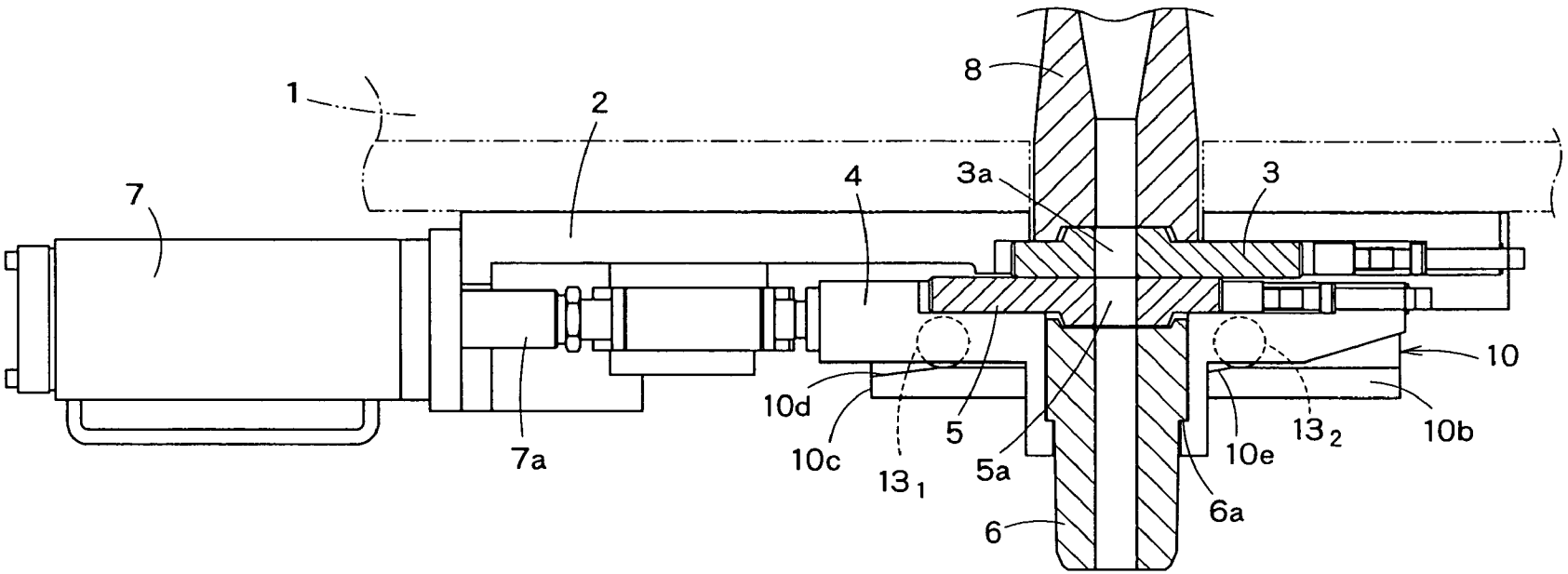
FIG. 3 is a sectional view taken on the line X-X in FIG. 2.
Figure 4:
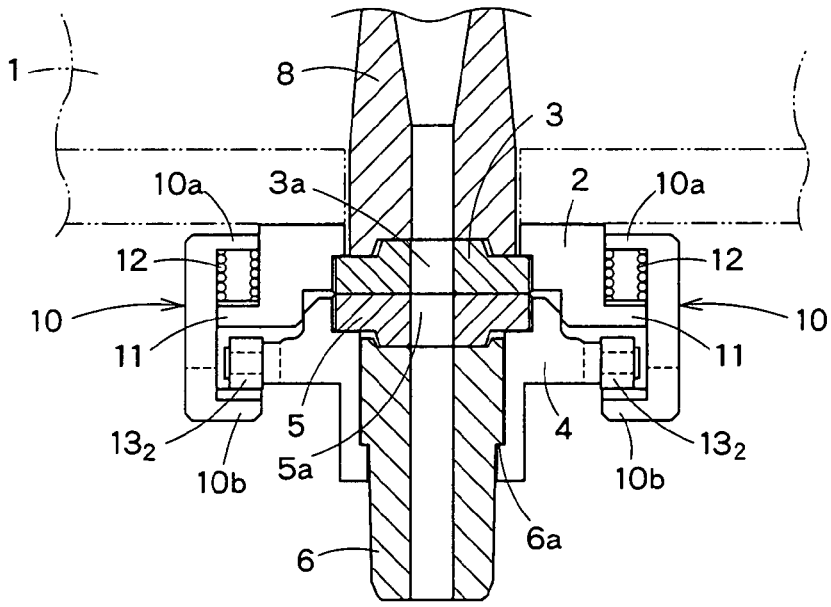
FIG. 4 is a sectional view taken on the line Y-Y in FIG. 2.

FIG. 1 is a side elevation of a slide gate valve unit in a preferred embodiment according to the present invention, FIG. 2 is a bottom view of the slide gate valve unit shown in FIG. 1, FIG. 3 is a sectional view taken on the line X-X in FIG. 2 and FIG. 4 is a sectional view taken on the line Y-Y in FIG. 2. FIG. 3 was used previously for the description of the background art. Reference characters used in FIG. 3 will be used for designating parts of the slide gate valve unit of the present invention.

The slide gate valve unit in the preferred embodiment is a two-layer type slide gate valve. A base frame 2 is secured to the bottom wall of a molten metal container 1. A slide case 4 is disposed under the base frame 2. A fixed plate 3 is combined with the base frame 2. A slide plate 5 is supported on the slide case 4. A shoot nozzle 6 having a shoulder 6*a* is suspended from the slide case 4.

A hydraulic or electric cylinder actuator 7 held on the base frame 2 has a rod 7*a* connected to one end of the slide case 4. The rod 7*a* of the cylinder actuator 7 is moved axially to locate the slide case 4 at a fully open position A to align a nozzle hole 5*a* formed in the slide plate 5 with a nozzle hole 3*a* formed in the fixed plate 3, at a fully closed position B to separate the nozzle hole 5*a* from the nozzle hole 3*a* or at a part replacing position C to replace the slide plate 5 and/or the shoot nozzle 6.

Opposite side parts of the base frame 2 and the slide case 4 are received in grooves formed in a rigid pressing members 10 having a substantially U-shaped cross section.

Figure 5:
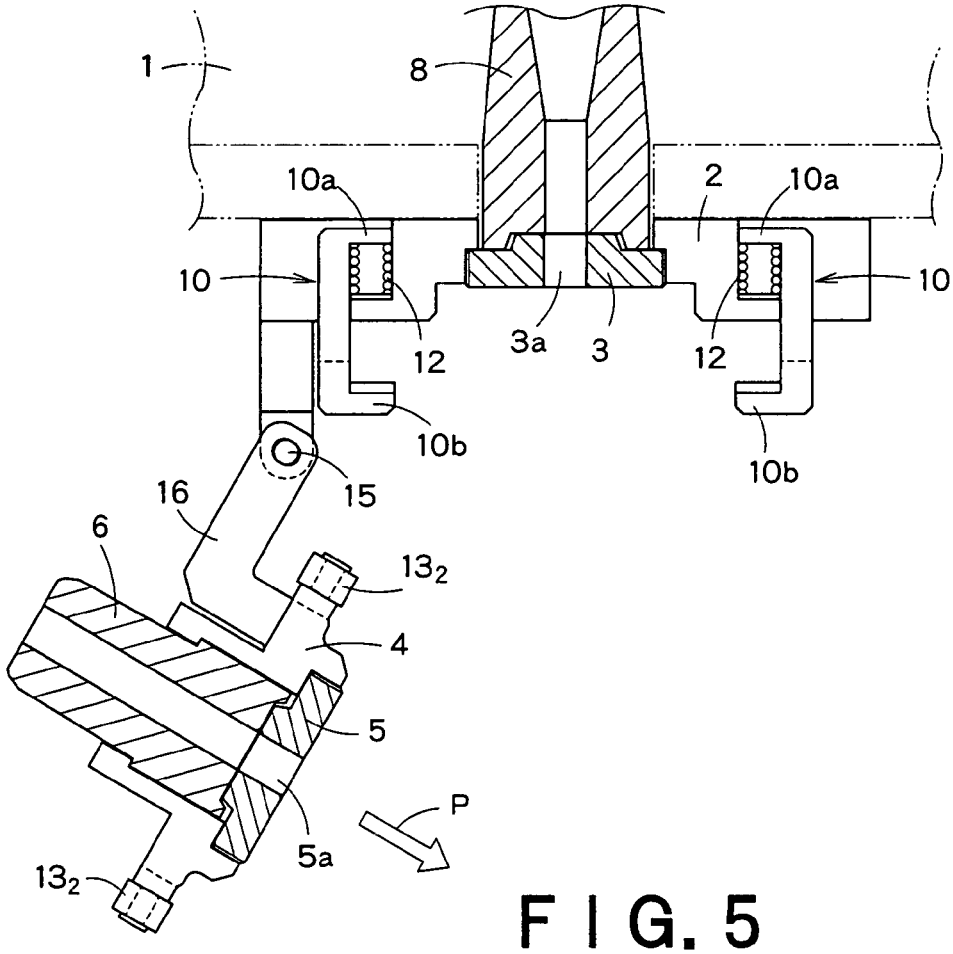
FIG. 5 is a sectional view of the slide gate valve unit, in which a slide case has been turned outward.

As shown in FIGS. 4 and 5, protrusions 11 protrude horizontally from lower parts of the opposite side parts of the base frame 2. Compression springs 12, namely, elastic members, are extended between the upper surface of each protrusion 11 and the lower surface of an upper part 10*a* of each pressing member 10 to push the pressing members 10 upward. The elastic members are not limited to the compression springs and may be plate springs, volute springs or the like.

Lower parts 10*b* of the pressing members 10 extend under lower side parts of the slide case 4 such that the side parts of the slide case 4 are supported on the lower parts 10*b* of the pressing members 10.

Two rollers $\mathbf{13}_1$ and $\mathbf{13}_2$, namely, support members, are supported rotatably on each side part of the slide case 4. The rollers $\mathbf{13}_1$ and $\mathbf{13}_2$ roll along the upper surfaces of the lower parts 10*b* serving as rails. The support members do not need necessarily to be the rollers and may be any member capable of carrying out a function required by the present invention.

The lower part 10*b* of the pressing member 10 is provided with a cut 14. The position of the cut 14 is determined such that the roller $\mathbf{13}_2$ on the right side, as viewed in FIG. 3, falls into the cut 14 when the slide case 4 is moved to the part replacing position C and the roller $\mathbf{13}_1$ on the left side, as viewed in FIG. 3, leaves an end 10*c*. Parts of the upper surfaces of the lower parts 10*b* are inclined surfaces 10*d* and 10*e* sloping down toward the end 10*c* and the cut 14, respectively.

A shaft 15 is extended along one side part of the base frame 2. Bearing arms 16 projecting from a side part of the slide case 4 corresponding to the side part of the base frame 2 are slidably put on the shaft 15. The bearing arms 16 serve as the knuckles of a hinge. When the slide case 4 is moved to the part replacing position C, the rollers $\mathbf{13}_1$ are separated from the ends 10*c* of the lower parts 10*b* of the pressing members 10 and the rollers $\mathbf{13}_2$ can pass the cuts 14 of the lower parts 10*b* of the pressing members 10 and hence the slide case 4 can turn outward on the shaft 15 as shown in FIG. 5. The slide case 4 is thus turned and is set in an inclined position that facilitates removing the slide plate 5 and the shoot nozzle 6 from the slide case 4.

A stopper 17 for restraining the slide case 4 from accidentally moving to the part replacing position C during a normal operation can be advanced into and retracted from a space between the base frame 2 and a connecting part 4*a* of the slide case 4.

The stopper 17 is attached to the inner ends of support rods 18 slidably extended through holes formed in a side wall of the base frame 2. A handle 19 is attached to the outer ends of the support rods 18. The handle 19 is pushed to locate the stopper 17 at a working position (inner position). The handle 19 is pulled to locate the stopper 17 at an inoperative position (outer position). When the stopper 17 is advanced to the working position, the slide case 4 is restrained from moving to the part replacing position C. When the stopper 17 is retracted from the working position, the slide case 4 can be moved to the part replacing position C. Any other suitable stopper may be used instead of the stopper 17.

The operation of the slide gate valve unit in the preferred embodiment will be described.

During the normal operation, the rollers $\mathbf{13}_1$ and $\mathbf{13}_2$ of the slide case 4 rest on the upper surfaces of the lower parts 10*b* of the pressing members 10 as shown in FIGS. 1 and 3 and the resilience of the compression springs 12 pushes the slide case 4 upward through the pressing members 10. Consequently, the slide plate 5 is pressed against the fixed plate 3 by a predetermined pressure.

The stopper 17 is advanced into the space between the base frame 2 and the connecting part 4*a* of the slide case 4 to prevent the accidental movement of the slide case 4 to the part replacing position c.

FIG. 3 shows the slide gate valve unit in a molten metal discharging state in which the respective nozzle holes 3*a* and 5*a* of the fixed plate 3 and the slide plate 5 are aligned. To stop the discharge of the molten metal, the nozzle holes 3*a* and 5*a* are disconnected by extending the rod 7*a* of the cylinder actuator 7 so as to move the slide case 4 to the fully closed position B.

During the movement of the slide plate 5 from the fully open position A to the fully closed position B, the pressing members 10 keep pressing the slide plate 5 against the fixed plate 3 by the predetermined pressure to prevent the leakage of the molten metal and the penetration of air into the molten metal.

The melted shoot nozzle 6 and the melted slide plate 5 are replaced with new ones. The stopper 17 is retracted from the space between the base frame 2 and the connecting part 4*a* of the slide case 4, and then the rod 7*a* of the cylinder actuator 7 is retracted to move the slide case 4 to the part replacing position C.

When the slide case 4 is located at the part replacing position C, the rollers $\mathbf{13}_1$ are separated from the ends 10*c* of the lower parts 10*b* of the pressing members 10 and the rollers $\mathbf{13}_2$ coincide with the cuts 14, respectively, and hence the slide case 4 can be turned outward on the shaft 15 as shown in FIG. 5. Then, the slide case 4 is turned outward and the slide plate 5 and the shoot nozzle 6 are pulled in the direction of the arrow P from the slide case 4. Subsequently, a new shoot nozzle and a new slide plate are put on the slide case 4, the slide case 4 is turned to set the rollers $\mathbf{13}_1$ and $\mathbf{13}_2$ at a level corresponding to the upper surfaces of the lower parts 10*b* of the pressing members 10, and then the rod 7*a* of the cylinder actuator 7 is extended to set the gate slide valve unit in an operative state.

Then, the stopper 17 is advanced into the space between the base frame 2 and the slide case 4 and the operation is started.

Figure 6:
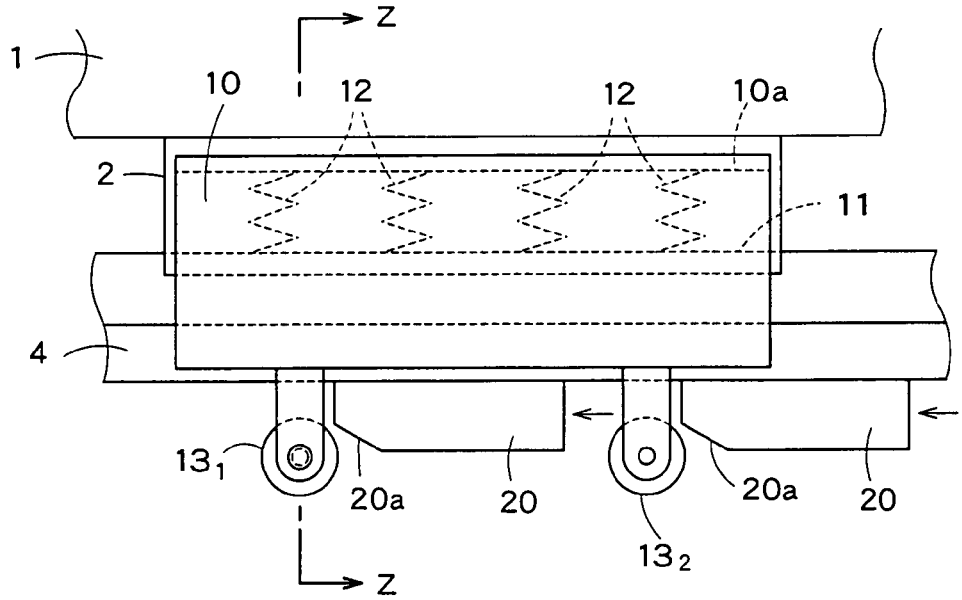
FIG. 6 is a partial side elevation of a slide gate valve unit in another embodiment according to the present invention.
Figure 7:
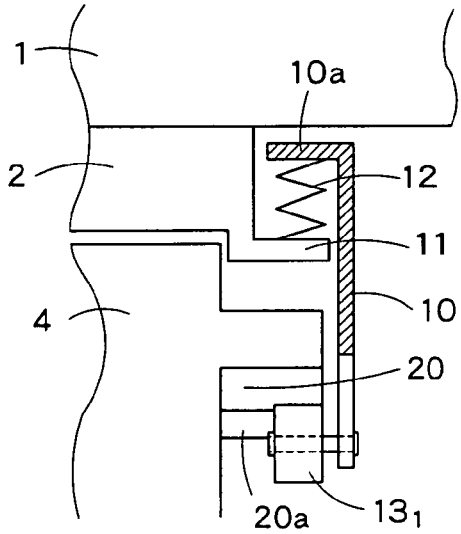
FIG. 7 is a sectional view taken on the line Z-Z in FIG. 6.

FIGS. 6 and 7 schematically illustrate a slide gate valve unit in another embodiment according to the present invention. This slide gate valve is a modification of the slide gate valve unit in the preferred embodiment formed by reversing the positional relation between the pressing members 10 and the rollers $\mathbf{13}_1$ and $\mathbf{13}_2$, namely, support members, of the slide case 4 in the slide gate valve unit in the foregoing embodiment.

Rollers $\mathbf{13}_1$ and $\mathbf{13}_2$ are rotatably supported on the lower parts 10*b* of the pressing members 10. Rails 20 are extended on parts of a slide case 4 extending under protrusions 11 formed on a base frame 2 so as to correspond to the rollers $\mathbf{13}_1$ and $\mathbf{13}_2$.

Bevels 20*a* are formed in front parts, with respect to a moving direction indicted by the arrow, of the support members 20 to enable the support members 20 to run easily onto the rollers $\mathbf{13}_1$ and $\mathbf{13}_2$. When the support members 20 run onto the rollers $\mathbf{13}_1$ and $\mathbf{13}_2$, the pressing members 10 are pulled down and elastic members 12 are deflected to press the sliding surface of a slide plate 5 against the sliding surface of a fixed plate 3 by a predetermined pressure.

The operation and effect of the slide gate valve unit in this embodiment are the same as those of the foregoing slide gate valve unit.

Although the present invention has been described as applied to the two-layer type slide gate valve unit, it goes without saying that the present invention is applicable to a three-layer slide gate valve unit.

The invention claimed is:

1. A slide gate valve unit comprising:

a fixed plate combined with a base frame secured to the lower surface of the bottom wall of a molten metal container;

a slide case supported for sliding under the fixed plate, internally provided with a slide plate and suspending a shoot nozzle; and a drive means for controlling the discharge of a molten metal by moving the slide case so as to align a nozzle hole formed in the slide plate with a nozzle hole formed in the fixed plate and so as to disconnect the nozzle hole of the slide plate from the nozzle hole of the fixed plate;

wherein right and left pressing members having a U-shaped cross section receive protrusions protruding from sides of the base frame and the lower surfaces of side parts of the slide case, elastic members are extended between upper parts of the pressing members and the upper surfaces of the protrusions of the base frame and side parts of the slide case are supported on the upper surfaces of the lower parts of the pressing members, and the resilience of the elastic members pushes the pressing members upward so that the slide case is pushed upward by the lower parts of the pressing members to press the sliding surface of the sliding plate against the sliding surface of the fixed plate by a predetermined pressure.

2. The slide gate valve unit according to claim 1, wherein at least two support members are attached to each of side parts of the slide case so as to be in contact with the upper surface of the lower parts of the pressing member to support the slide case slidably, bearing arms projecting from a side part, with respect to a moving direction in which the slide case moves, of the slide case are slidably put on a shaft attached to the base frame to enable the slide case to turn outward, a cut is formed in a lower part of each of the pressing members so as to permit one of the support members to pass the cut when the other support member comes off an end of the lower part, and the slide case can turn outward on the shaft when the support members come off the ends of the lower parts and the other support members can pass the cuts, respectively.

3. The slide gate valve unit according to claim 2, wherein parts of the upper surfaces of the lower parts of the pressing members are inclined surfaces sloping down toward the ends and the cuts, respectively.

4. The slide gate valve unit according to claim 2, wherein the support members are rollers.

5. The slide gate valve unit according to claim 1 further comprising a stopper for determining the stroke of the driving means for sliding the slide case, wherein the stopper is advanced to its working position to hold the slide case at a position for discharging the molten metal and the stopper is retracted from the working position to permit the slide case to be moved to a position where the slide case can be turned outward.

6. A slide gate valve unit for a casting machine, said slide gate valve unit comprising:

a fixed plate combined with a base frame secured to the lower surface of the bottom wall of a molten metal container;

a slide case supported for sliding under the fixed plate, internally provided with a slide plate and suspending a shoot nozzle; and a drive means for controlling the discharge of a molten metal by moving the slide case so as to align a nozzle hole formed in the slide plate with a nozzle hole formed in the fixed plate and so as to disconnect the nozzle hole of the slide plate from the nozzle hole of the fixed plate;

wherein right and left pressing members having a U-shaped cross section receive protrusions protruding from sides of the base frame and the lower surfaces of side parts of the slide case, elastic members are extended between upper parts of the pressing members and the upper surfaces of the protrusions of the base frame, rollers are supported on lower parts of the pressing members, support members supporting the slide case are rails that move on the rollers, and the resilience of the elastic members pushes the pressing members upward to push the slide case upward through the rollers attached to the lower parts of the pressing members so that sliding surface of the slide plate is pressed against the sliding surface of the fixed plate by a predetermined pressure.

* * * * *